US005470250A

United States Patent [19]

Hawk et al.

[11] Patent Number: 5,470,250

[45] Date of Patent: Nov. 28, 1995

[54] BRIDGING TERMINAL BLOCK

[75] Inventors: Kenneth C. Hawk, Clemmons, N.C.; Harry M. Capper, Harrisburg; James W. Robertson, Oberlin, both of Pa.

[73] Assignee: The Whitaker Corporation, Wilmington, Del.

[21] Appl. No.: 251,074

[22] Filed: May 31, 1994

[51] Int. Cl.[6] ..... H01R 4/24

[52] U.S. Cl. ..... 439/409; 439/507

[58] Field of Search ..... 439/709–725, 439/394–405, 507–513

[56] References Cited

U.S. PATENT DOCUMENTS

| | | | |
|---|---|---|---|
| 2,917,724 | 12/1959 | Jackson | 439/722 |
| 3,249,908 | 5/1966 | Fuller et al. | 339/98 |
| 3,665,376 | 5/1972 | Paris et al. | 439/722 |
| 4,089,041 | 5/1978 | Lockard | 361/403 |
| 4,152,686 | 5/1979 | Hughes | 336/192 |
| 4,195,194 | 3/1980 | Kuster et al. | 439/507 |
| 4,575,168 | 3/1986 | Thomas | 439/507 |
| 4,613,194 | 9/1986 | Pohl | 439/507 |
| 4,624,518 | 11/1986 | Seidel | 339/97 P |
| 4,954,090 | 9/1990 | Shimochi | 439/721 |
| 5,145,388 | 9/1992 | Brownlie et al. | 439/142 |
| 5,219,302 | 6/1993 | Robertson et al. | 439/404 |
| 5,317,474 | 5/1994 | Capper et al. | 361/119 |
| 5,321,577 | 6/1994 | Capper et al. | 361/119 |
| 5,326,275 | 7/1994 | Murakami | 439/507 |

FOREIGN PATENT DOCUMENTS 0529957 3/1993 European Pat. Off. .

OTHER PUBLICATIONS

*AMP Catalog 82257*, "AMP Quiet Front Terminal Block", (Sep. 1991), pp. 1–6; AMP Incorporated, Harrisburg, Pa.

U.S. Ser. No. 07/955,535 filed Oct. 1, 1992 (Abstract and Drawings only).

U.S. Ser. No. 08/166,180 filed Dec. 10, 1993 (Abstract and Drawings only).

U.S. Ser. No. 08/035,129 filed Mar. 18, 1993 (Abstract and Drawings only).

U.S. Ser. No. 08/204,975 filed Mar. 2, 1994 (Abstract and Drawings only).

*Primary Examiner*—David L. Pirlot

*Attorney, Agent, or Firm*—Anton P. Ness

[57] ABSTRACT

A terminal block assembly (10) including at least two terminals (20) and associated actuators (24) in housing sections (14) for termination to ends of conductors (28,30) inserted into aligned apertures therethrough upon actuation of the terminals. Bridging element (50) includes contact sections (54) held in cavities (22) of housing sections (14) to be assuredly compressed against terminals (20) thus electrically interconnecting terminals (20) and commoning all wires (28,30) terminated by terminals (20). A cover member (90) may be secured beneath the terminal block assembly for insulative protection.

4 Claims, 7 Drawing Sheets

BRIDGING TERMINAL BLOCK

FIELD OF THE INVENTION

The present invention relates to the field of electrical connectors and more particularly to connectors for connecting conductor wires together.

BACKGROUND OF THE INVENTION

In the telecommunications industry telephone cable is introduced to individual telephone sites such as residences, mainly through use of a splice of the signal wires of the cable to respective house wires at a junction located outside or inside the house. The junction is housed within a protective enclosure which is mounted usually to an outside wall of the house.

One example of a terminal block for interconnecting a pair of wires is disclosed in U.S. Pat. No. 5,219,302. A dielectric housing has two generally tubular terminal-receiving sections, each having a center post therein defining an annular cavity. A barrel-shaped terminal is movably disposed within each cavity adjacent the center post, and includes connecting sections for two wires to be spliced; each connection section is of the insulation piercing or displacement type that eliminates the need for stripping the insulation from the wire conductors. A tubular actuator is also mounted to the housing and is adapted to be rotated between actuated and unactuated positions to rotate the rotatable terminal.

A pair of wire-receiving apertures extend through apertures through the housing wall of each cavity, through apertures of the terminal and the actuator, and at least into a center post aperture, all aligned in an unactuated state for a wire end to be inserted thereinto. During splicing, the wire ends of both wires are inserted into respective openings and through the terminal apertures and at least into the center post apertures until stopped by abutment with corresponding stop surfaces of the housing which then holds the wire ends at two spaced locations, both outside and within the terminal wall. Upon rotation of the terminal by the actuator about a quarter turn, slot walls of the terminal extending circumferentially from the terminal apertures pierce the wire insulation of respective wires, and the constricted edges of the precisely profiled slot engage the wires' conductors, completing the splice.

One advantage of the terminal block of U.S. Pat. No. 5,219,302 is that it has a modular nature and is self-sufficient to crossconnect two cables: the same housing has two terminals therein for crossconnecting the tip and ring wires of the distribution cable with corresponding tip and ring wires of the service cable, and the housing member can be selectively mounted in an enclosure adapted for a plurality of such modules.

U.S. patent application Ser. No. 07/955,535 filed Oct. 1, 1992 and assigned to the assignee hereof discloses a similar terminal block containing sealing material embedding the barrel terminal and the wire ends inserted into the terminal block, especially sealing material having a gel-like consistency. A tape element is disclosed to be affixed to the outer surface of the housing traversing the wire-receiving apertures and containing holes therethrough smaller in diameter than the nominal wire diameter; the tape is tough and durable with elastic properties to be stretched by the wire upon insertion through the holes and into the terminal block aperture for termination, with the tape thereafter tightly gripping the wire insulation preventing sealing material from being withdrawn from the terminal block upon removal of a wire end.

It is desired to provide a terminal block with internal commoning between the terminals, thus commoning all conductors terminated within the housing.

It is also desired to provide such a terminal block adapted to terminate a plurality of wires without requiring stripping of insulation therefrom.

It is further desired to provide such a terminal block that inherently seals the splice connections, and enables the removal and replacement of one or more wire ends as desired and inherently reseals the resultant splice as well.

SUMMARY OF THE INVENTION

The present invention includes a dielectric housing with at least two generally tubular terminal-receiving housing sections defining annular cavities containing respective barrel-shaped terminals movably secured therewithin, and actuators for rotating the terminals. Each housing section includes one or more wire-receiving apertures, and the terminal therewithin also includes one or more wire-receiving apertures aligned therewith when the terminal is in its unactuated position, allowing insertion into each set of aligned apertures a corresponding wire end. Slots extend from each wire-receiving aperture of the terminal precisely profiled to penetrate the insulation of the wire end during rotation of the terminal from its unactuated position to its actuated position, and engage the conductor of the wire.

A bridging element is affixed within the dielectric housing having portions in assured electrical engagement with each of the terminals, thus commoning the terminals and all wire ends terminated thereto. Sealant material preferably disposed in the terminal-receiving sections embeds and seals the terminals and wire ends and also at least the portions of the bridging element extending into the terminal-receiving cavities and engaging the terminals.

Preferably the bridging element includes upstanding stiff elongate pin sections extending to respective free ends from a body section. The pin sections are easily insertable into respective openings along the bottom surface of the module to extend into respective terminal-receiving cavities and along the barrel-shaped terminals in a compression fit against surfaces thereof to establish assured electrical connections therewith without solder. Preferably the pin sections are disposed along grooves along the side surfaces of central post sections within the annular terminal-receiving cavity around which the terminals are disposed, and the grooves hold the pin sections as the terminals are rotated such that the pin sections remain assuredly compressed against the terminals' surfaces at all times. In a housing module having two terminal-receiving housing sections, the bridging element may conveniently be a formed length of wire with parallel pin sections at its ends insertable into respective housing apertures after the housing module has been molded, either before or after the terminals and actuators have been assembled thereto, with the bridging element body section extending along the bottom surface of the housing module. Alternatively the bridging element may be insert molded entirely within the housing module.

In another embodiment a cover may be secured beneath the housing module for insulation of the bridging element, and may be filled with sealant material for protection thereof against corrosion.

In one particularly useful application, two such bridging terminal blocks of the present invention may be used with a single surge protective terminal block in the interconnection of the tip and ring conductors of a single telephone distribution cable, to the tip and ring conductors of three (or more) discrete service cables of a single customer, all mountable within a common enclosure and all permitting removal and replacement of wires.

It is an objective of the present invention to provide a terminal block for terminating ends of a plurality of wires, for splicing or commoning the wires to each other, without requiring removal of insulation from the wires.

It is an additional objective for such terminal block to provide for inherent sealing of the splice connections.

It is additionally an objective for such terminal block to permit removal and replacement of one or more wire ends, and inherent resealing thereof.

Embodiments of the present invention will now be described by way of example with reference to the accompanying drawings.

DETAILED DESCRIPTION OF THE PREFERRED EMBODIMENTS

Figure 1:
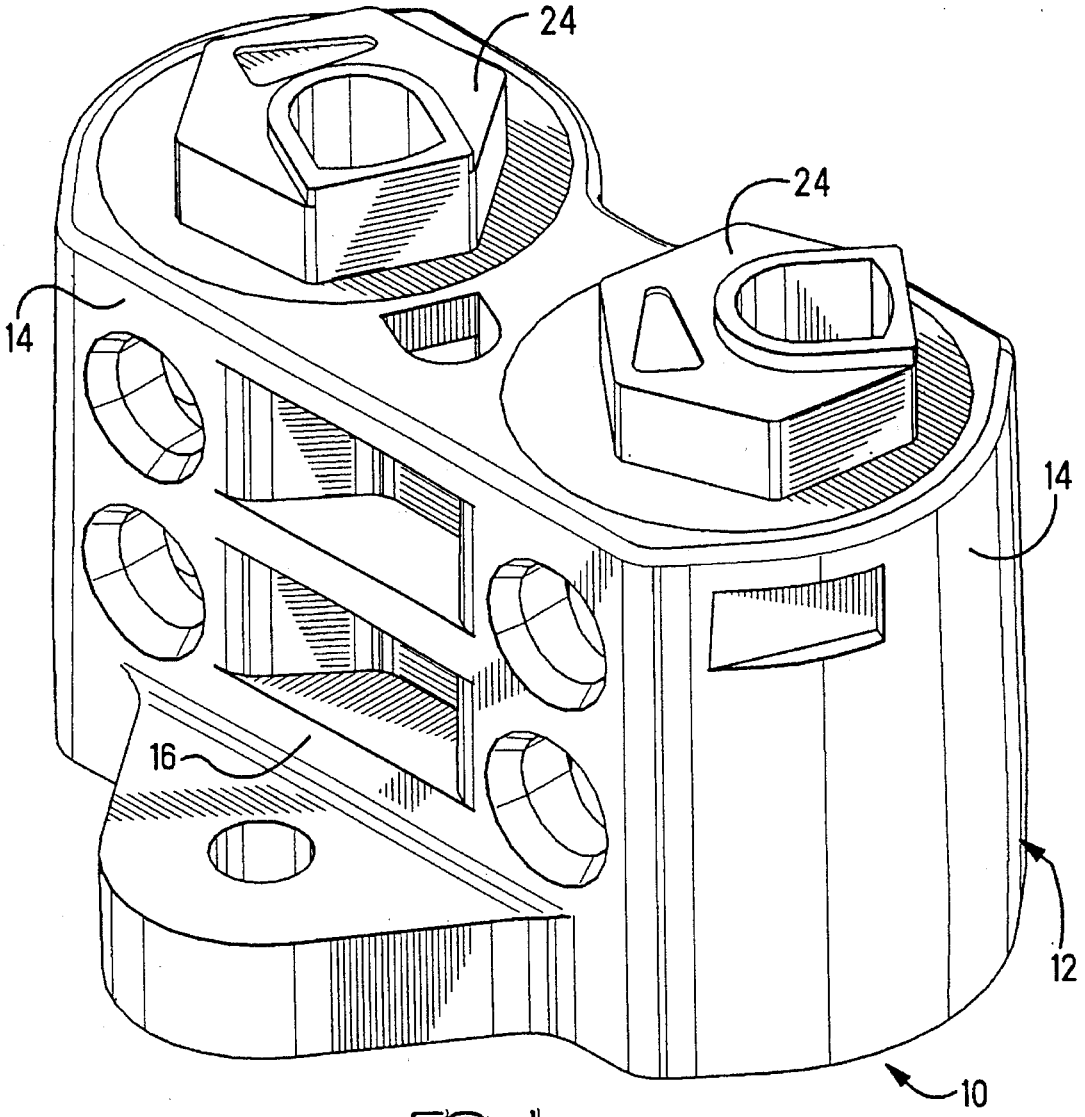
FIGS. 1 and 2 are isometric views of the connector of the present invention from above and below.
Figure 2:
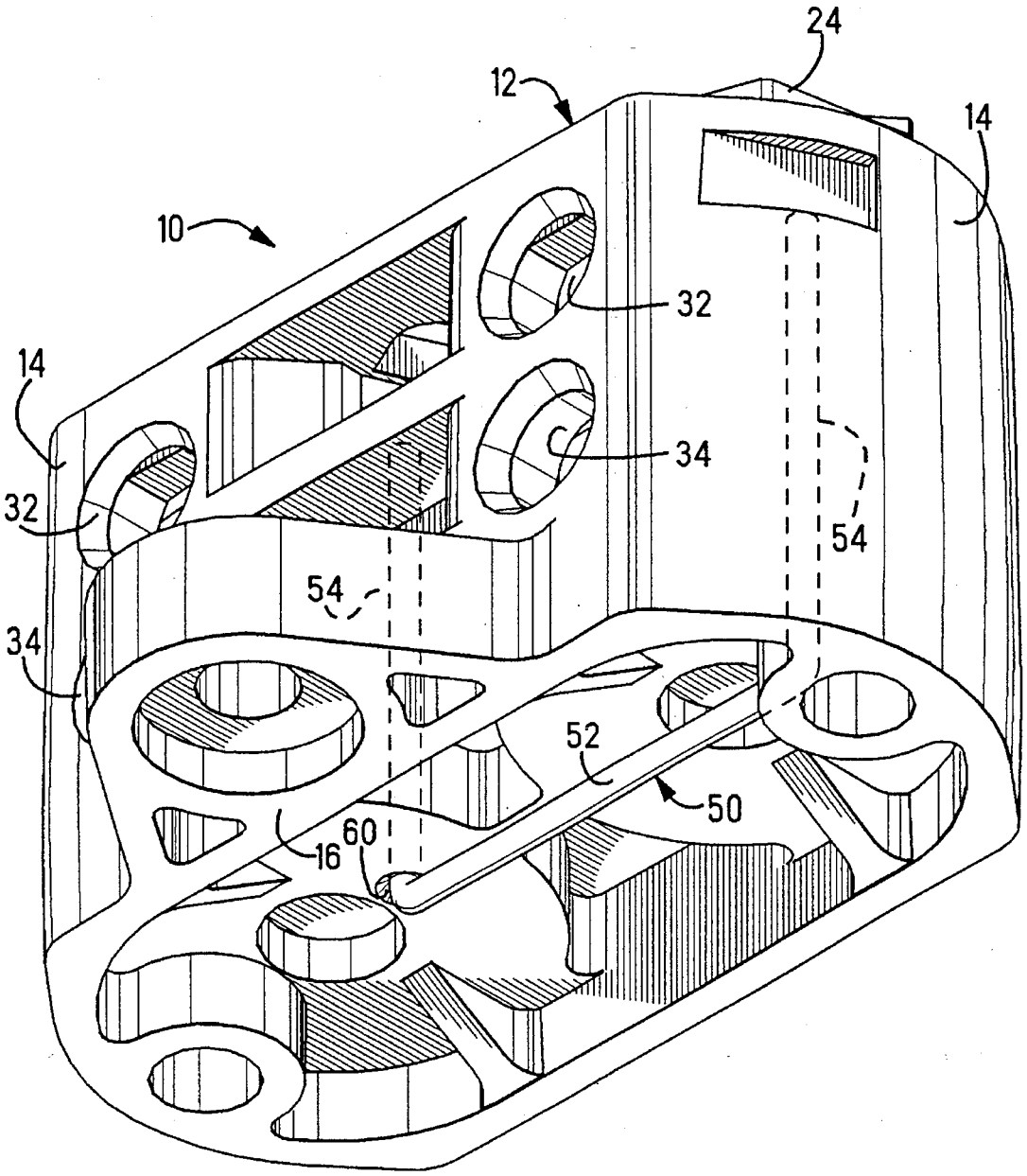
Figure 3:
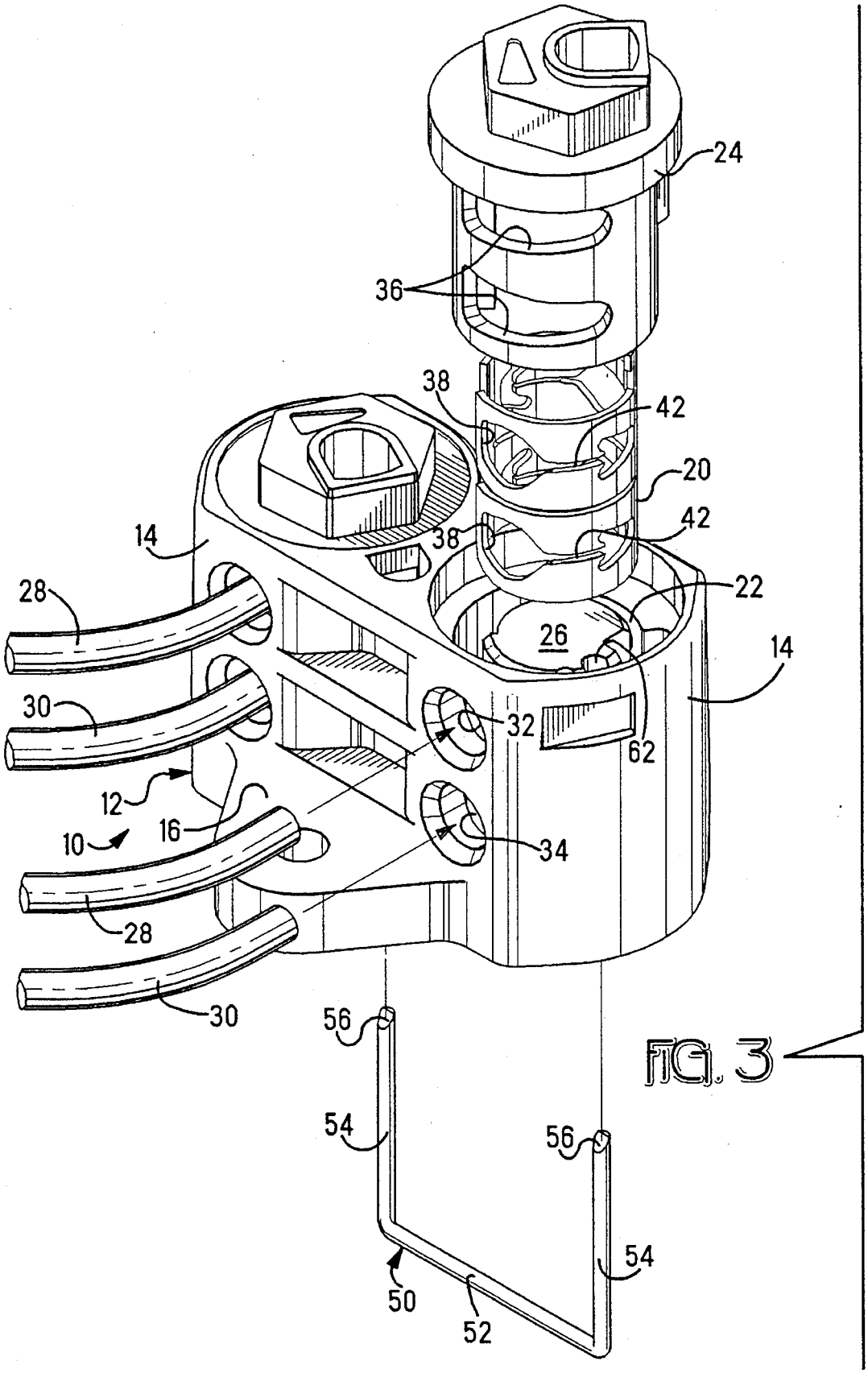
FIG. 3 is an isometric view of the connector with the terminal, actuator and bridging element of the present invention exploded from the housing.
Figure 4:
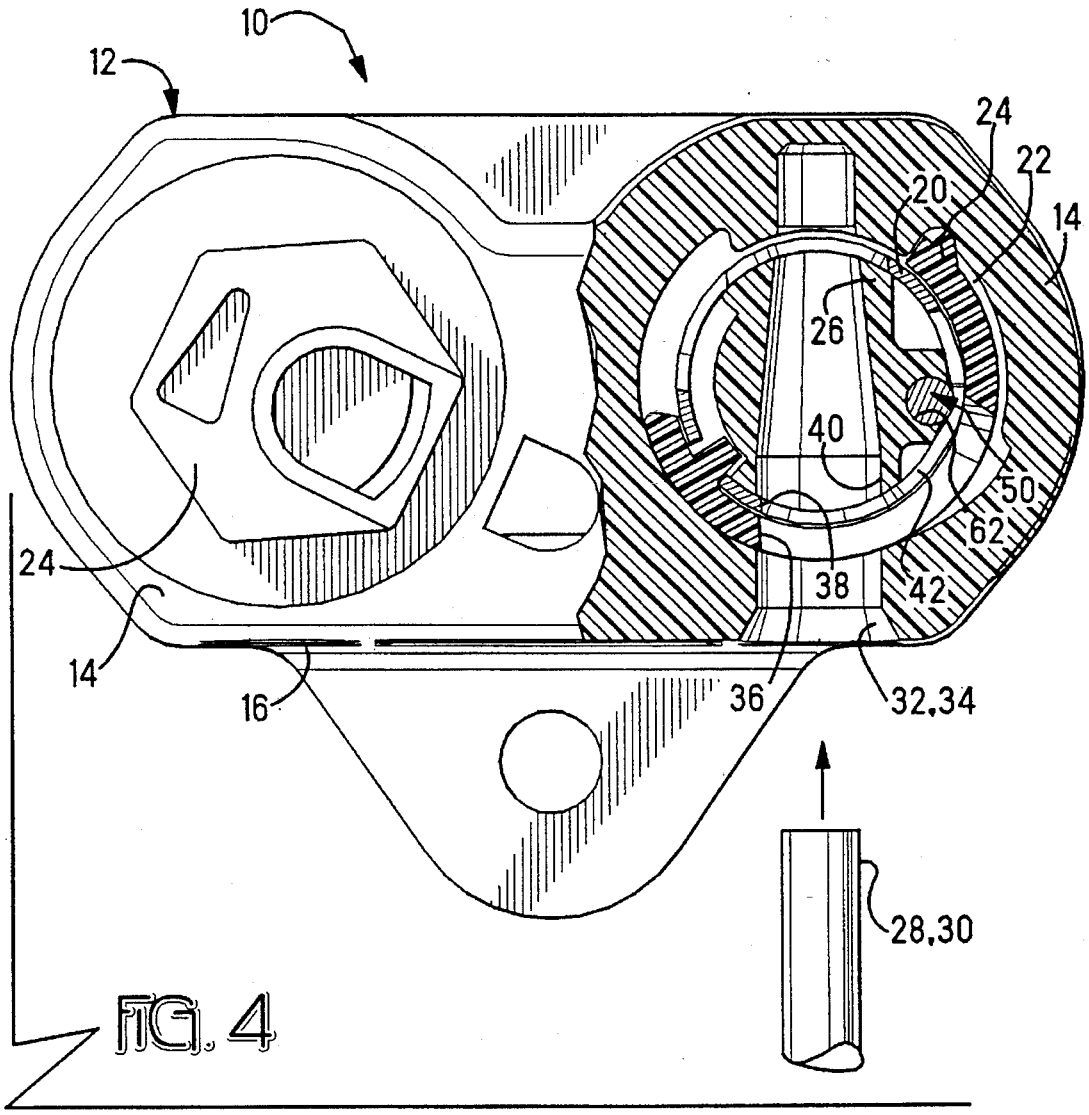
FIG. 4 is a cross-section view of the connector of FIG. 1 illustrating the aligned wire-receiving apertures of the connector elements and also the contact section of the bridging element in engagement with the terminal.
Figure 5:
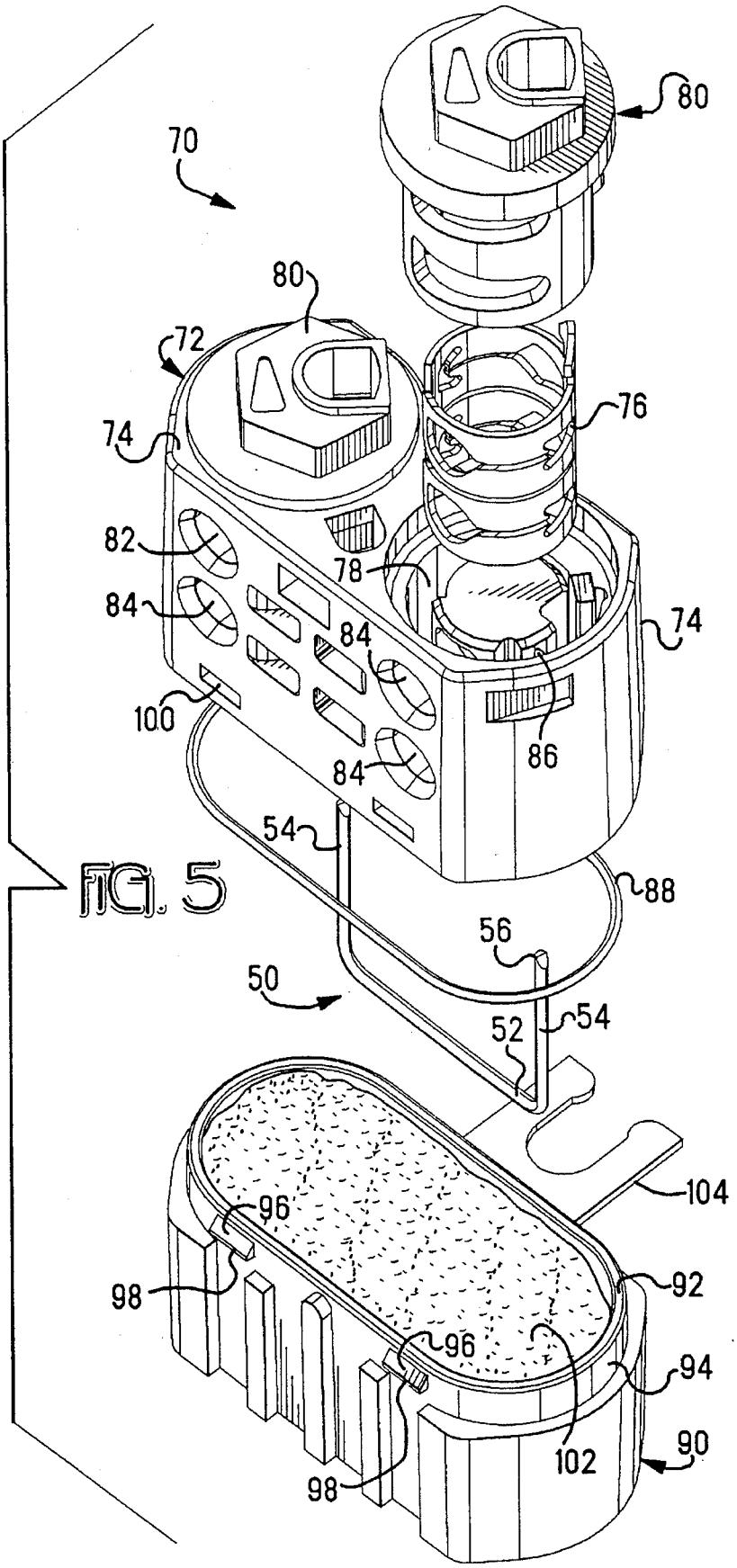
FIGS. 5 and 6 are exploded and assembled isometric views of another embodiment of a connector of the present invention, including a protective bottom cover with sealant.

Terminal block 10 is shown in FIGS. 1 and 2 to include a dielectric housing module 12 having two generally tubular housing sections 14 extending from a common base section 16. Referring to FIGS. 3 to 5, barrel-shaped terminals 20 are disposed in annular cavities 22 of each housing section 14, with an actuator member 24 extending into the top of each housing section to enable rotating the terminals from unactuated positions to actuated positions to terminate the wires. Each terminal 20 closely surrounds a center post 26 in each cavity 22, and actuator member 24 surrounds the barrel-shaped terminal. Actuator member 24 includes embossments engaging terminal 20 to enable it to rotate the terminal within the annular cavity and about center post 26, between unactuated and actuated positions. Ends of two wires 28,30 are insertable through openings 32,34 in the housing section 14, through openings 36 of the actuator and apertures 38 of terminal 20, and at least into respective apertures 40 of the center post (FIG. 4), all of which are coaligned when the actuator and terminal are in the unactuated position. Upon rotation of terminal 20 to its actuated position by actuator 24, profiled slots 42 extending from the apertures of the terminal penetrate the wire insulation and electrically engage the conductors of both wires thereby interconnecting them, as is disclosed in U.S. Pat. No. 5,219,302.

Advantageously the housing module is provided with a mounting flange enabling securing of the terminal block assembly into an enclosure using a conventional fastener, as disclosed in U.S. Pat. No. 5,219,302. Optionally, sealing material may be disposed within the annular cavities, embedding the terminals and their interconnections to the wire ends and the bridging element, and a tape element may be used across the wire-receiving apertures of each housing section 14 to facilitate retention of the sealant material therein, all as disclosed in U.S. patent application Ser. No. 07/955,535 filed Oct. 1, 1992 and assigned to the assignee hereof.

Bridging element 50 of the present invention is seen in FIGS. 2 to 5, being a conductive member that after assembly into connector 10, electrically engages both terminals 20 to define an interconnection that is essentially a splice. Thus all wires terminated to terminals 20 become commoned simply by being inserted into apertures 32,34 of connector 10 and the terminals being rotated by actuator 24 to their actuated positions. Bridging element 50 includes a body section 52 from which extend contact sections 54 to leading ends 56. As shown, bridging element is a length of wire formed such that contact sections 54 coextend vertically upwardly in parallel from respective ends of body section 52. In FIG. 3, contact sections 54 are both inserted into respective holes 60 (FIG. 2) along the bottom of connector housing 12 and into respective annular cavities 22. Preferably holes 60 include widened entrances facilitating initial insertion of leading ends 56 of contact sections 54, which also preferably are tapered.

As seen in FIG. 4, each contact section 54 then is disposed in a respective groove 62 along the side surface of center post 26 and along the inside surface of terminal 20. Groove 62 is formed to have a depth less than the diameter of the contact section such that a portion of contact section 54 protrudes into annular cavity 22 to engage the inside surface of the terminal. The arrangement assures that the contact section remains compressed against the inside surface of the terminal before and after rotation between unactuated and actuated positions.

It is preferred that the bridging element for the two-terminal assembly shown be a length of wire such as of copper alloy and plated with tin. Potting material may be disposed along the bottom surface of the terminal block for sealing and insulative protection of the exposed portions of the bridging element, or alternatively, sealant gel may similarly be used especially where the terminal block is mounted onto a surface such as the bottom of an enclosure.

Figure 6:
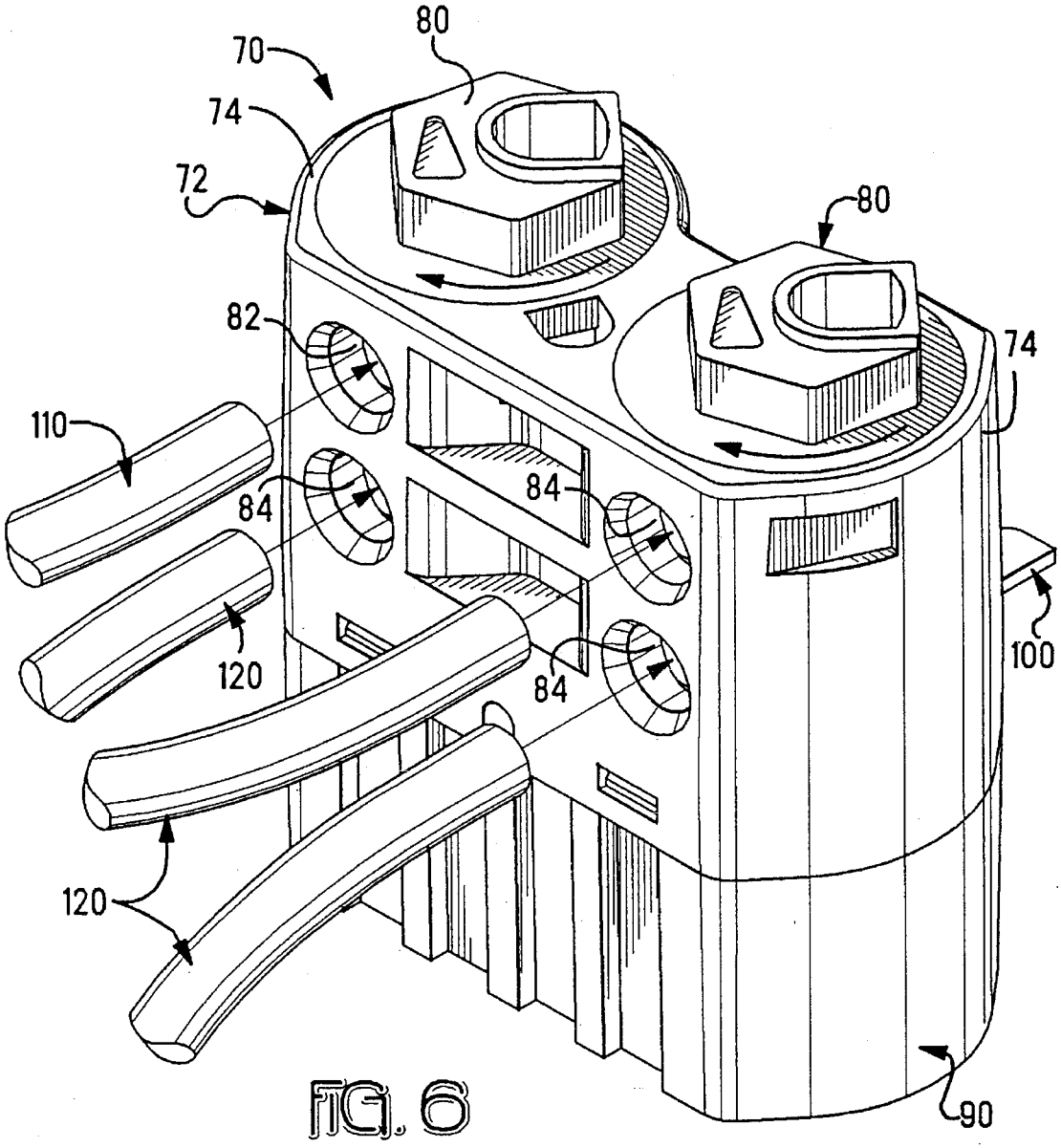

In another embodiment of connector 70, a bottom cover member 90 may be used as shown in FIGS. 5 and 6. Main housing 72 includes a pair of housing sections 74, each with a respective barrel terminal 76 inserted into annular cavity 78 thereof, and an actuator 80, all similarly to connector 10 of FIGS. 1 to 4. Wire-receiving apertures 82,84 extend into the housing sections for receipt of wires 110,120 for termination. The top end of groove 86 is seen along the center post of the exposed housing section, associated with one of the contact sections 54 of bridging element 50 that extends upwardly from body section 52 to leading end 56.

Bottom cover 90 is adapted to be secured to the bottom surface of main housing 72 and may be adapted to trap therebetween a resilient sealing member 88, if desired. The top edge surface 92 of upstanding peripheral flange 94 of bottom cover 90 cooperates with a complementary groove (not shown) around the bottom of main housing 72 for seating the sealing member 88. A pair of latching projections 96 are seen near top edge surface 92 along one side of peripheral flange 94, defining downwardly facing latching surfaces 98 that are received into latching apertures 100 of main housing section 72 to secure bottom cover 90 thereto upon full assembly.

Preferably, bottom cover 90 contains sealant material 102 such as is disclosed in U.S. patent applications Ser. No. 07/749,373 filed Aug. 23, 1991 and Ser. No. 07/878,807 filed May 5, 1992, both assigned to the assignee hereof. Optionally, a mounting flange 104 is affixed or formed integrally with bottom cover 90 to enable connector assembly 70 to be affixed within an enclosure such as is disclosed in U.S. Pat. No. 5,219,302 or U.S. patent application Ser. No. 08/035,129 filed Mar. 18, 1993 and assigned to the assignee hereof.

Figure 7:
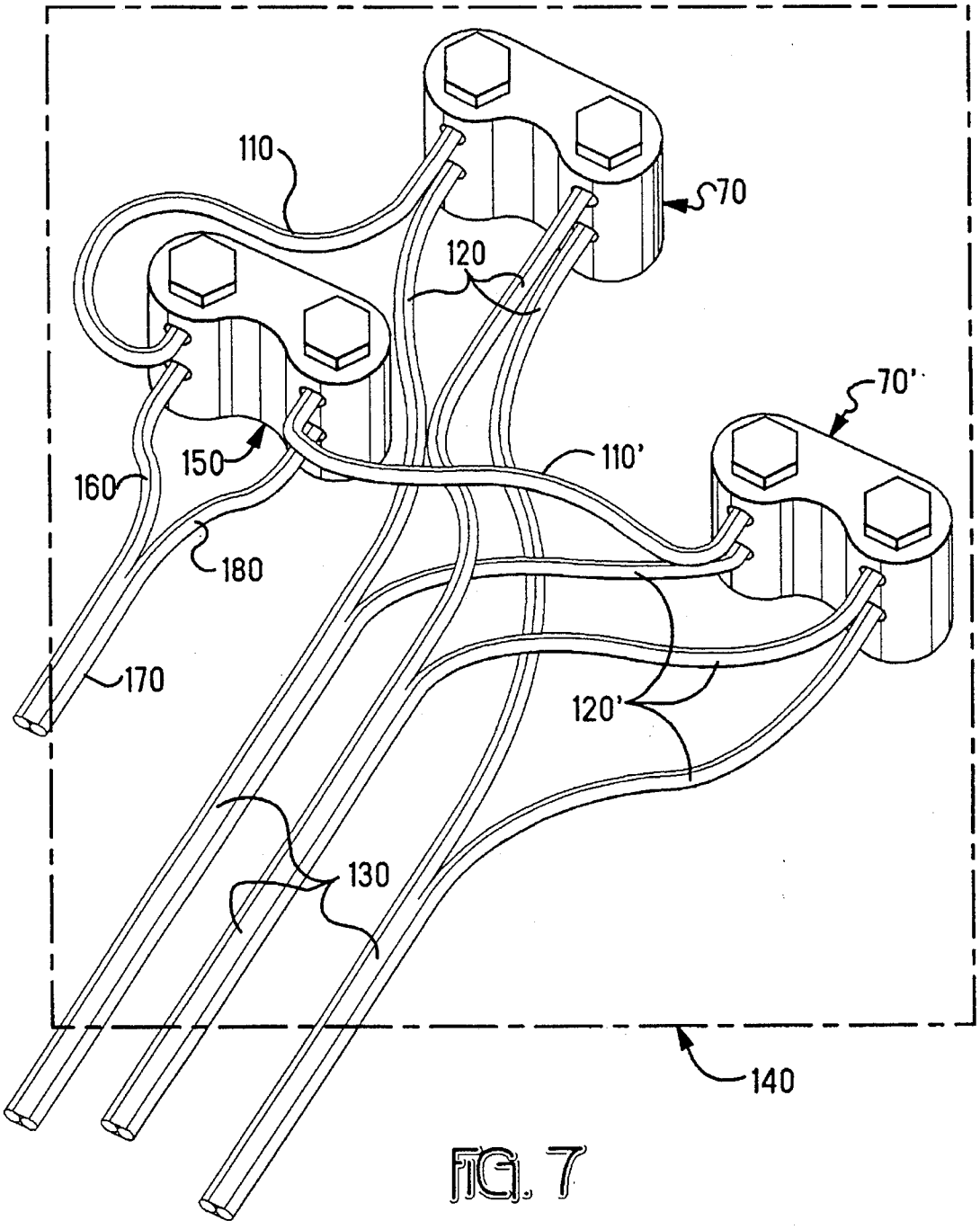
FIG. 7 is a diagrammatic illustration of an arrangement of two connectors of the present invention with a surge protected module in the interconnection of telephone distribution cable to a plurality of service cables of a single customer.

One particularly valuable application of the present invention is useful in the telecommunications field, for the interconnection of telephone cables to individual customer locations such as residences. Referring particularly to FIGS. 6 and 7, an aperture 82 extends into one of the housing sections for receipt of distribution wire 110, along with a second aperture 84 thereinto, and third and fourth apertures 84 extend into the other housing section all for receipt of respective service wires 120. Distribution wire 110 is connected by one portion of a surge protective terminal block 150 to either a tip wire 160 of telephone cable 170, or a ring wire 180 thereof. Three service wires 120 are commoned to distribution wire 110 by connector 70 and extend to respective two-wire service cables 130 entering the residence of a single customer for three separate telephone units. Surge protective terminal block 150 may be as disclosed in U.S. patent application Ser. No. 08/059,789 filed May 7, 1993 and assigned to the assignee hereof. Surge protective terminal block 150, bridging connector 70 and second bridging connector 70' may all be mounted within a common enclosure 140 for convenience.

Second bridging connector 70' as seen in FIG. 7 receives the another of the distribution wires 110' connected by the other portion of surge protective terminal block 150 to the other of the tip and ring wires 160,180 of telephone cable 170, and includes three service wires 120' extending therefrom to service cables 130. The arrangement very conveniently permits and facilitates the connection of a single distribution cable 170 to three discrete service cables 130 with protection of the service lines and electrically connected apparatus against current and voltage surges, all using a single surge protective terminal block with two bridging terminal blocks of the present invention, and all permitting removal and replacement of wires from the terminal blocks during servicing.

Alternatively, the assembly could be modified for the terminal to be disposed around the outer surface of the actuator and adjacent the inner surface of the annular cavity (not shown), so that the contact section could be extended along a groove of the cavity inner surface and held compressed against the outer surface of the terminal for electrical engagement.

It can be seen that the assembly could have one wire-receiving aperture per housing section, for interconnecting two conductors, or three or more apertures could be provided in the housing sections, terminals and actuators for interconnecting and commoning a plurality of conductors. Further the assembly could include three or more housing sections each with a terminal and actuator, and the bridging element would thus be provided with a corresponding three or more contact sections.

While a bridging element with coextending parallel contact sections facilitates insertion into a molded housing, either before or after a terminal has been disposed in the annular cavity, it is envisioned that a bridging element could be molded into the housing member by conventional insert molding techniques, so long as a portion of each contact section remains exposed within the respective annular cavity to become assuredly electrically engaged with a corresponding terminal upon full terminal block assembly.

Other modifications can be devised that are within the spirit of the invention and scope of the claims.

We claim:

1. A terminal block assembly for interconnecting respective conductors of insulated wires, the assembly being of the type having a housing member having at least two housing sections for respective terminals, and terminals disposed in respective terminal-receiving cavities of the terminal housing sections each having at least one conductor-receiving opening of the terminal housing sections for receipt of a respective at least one conductor thereinto for termination to a respective terminal, characterized in that:

a wire member bridging element is disposed in the housing member including a body section having respective contact sections at the ends thereof associated with each said terminal, said contact sections coextending from said body section and being adapted to be inserted into respective holes into a bottom surface of said housing member and received along grooves of a terminal-proximate internal surface of said terminal-receiving cavities of two of said at least two housing sections, each said groove having a depth less than a diameter of said contact section such that a portion of said contact section protrudes into a respective said terminal-receiving cavity to engage a surface of a respective said terminal for electrical engagement with said associated terminal upon full assembly of the terminal block assembly, thus commoning said terminals of said at least two housing sections; and said housing member is adapted to contain said bridging element for said contact sections thereof to engage said terminals, whereby all conductors inserted into apertures of the assembly become commoned upon termination to respective terminals upon actuation of the terminals.

2. The terminal block assembly as set forth in claim 1 further characterized in that a cover member is securable to said housing member for insulative protection of said bridging element.

3. The terminal block assembly as set forth in claim 1 further characterized in that each said terminal-receiving cavity is an annular cavity defined around an outwardly facing side surface of a respective center post of said housing member around which is disposed said terminal, and said groove is disposed along the side surface of said center post, and upon insertion into said respective hole and along said groove, said contact section of said bridging element protrudes away from said side surface of said center post and is held compressed against an inside surface of said terminal when in either said unactuated position or said actuated position.

4. The terminal block assembly as set forth in claim 3 further characterized in that a cover member is securable to said housing member for insulative protection of said bridging element.

* * * * *